US007723968B2

(12) United States Patent
Okuyama et al.

(10) Patent No.: US 7,723,968 B2
(45) Date of Patent: May 25, 2010

(54) TECHNIQUE FOR IMPROVING EFFICIENCY OF A LINEAR VOLTAGE REGULATOR

(75) Inventors: Fabio Hideki Okuyama, Campinas (BR); Andre Luis Do Couto, Jaguariuna (BR)

(73) Assignee: Freescale Semiconductor, Inc., Austin, TX (US)

( * ) Notice: Subject to any disclaimer, the term of this patent is extended or adjusted under 35 U.S.C. 154(b) by 226 days.

(21) Appl. No.: 11/682,674

(22) Filed: Mar. 6, 2007

(65) Prior Publication Data

US 2008/0218137 A1 Sep. 11, 2008

(51) Int. Cl.
*G05F 1/565* (2006.01)
*G05F 1/575* (2006.01)

(52) U.S. Cl. ..... 323/274; 323/275

(58) Field of Classification Search ..... 323/273, 323/274, 275, 277, 279, 280, 281; 361/111
See application file for complete search history.

(56) References Cited

U.S. PATENT DOCUMENTS 6,522,111 B2 2/2003 Zadeh et al.
6,806,690 B2 * 10/2004 Xi ..... 323/273
7,391,192 B2 * 6/2008 Ostrom et al. ..... 323/274
7,443,149 B2 * 10/2008 Nishimura et al. ..... 323/280

* cited by examiner

*Primary Examiner*—Gary L Laxton
(74) *Attorney, Agent, or Firm*—Dillon & Yudell LLP

(57) ABSTRACT

A linear voltage regulator includes a first transistor, a feedback circuit, and a control circuit. The first transistor includes a first terminal coupled to an input terminal of the regulator, a second terminal coupled to an output terminal of the regulator, and a control terminal. The first transistor is configured to provide a load current to the output terminal at a desired voltage level based on a control signal on the control terminal. The feedback circuit is coupled to the output terminal and is configured to generate a feedback signal based on an actual voltage level at the output terminal. The control circuit is configured to provide, based on the feedback signal, the control signal at a level to substantially maintain an output voltage at the output terminal at the desired voltage level. An operating current of the control circuit is configured to increase, by a limited amount, responsive to a transient increase in the load current.

17 Claims, 6 Drawing Sheets

-PRIOR ART-

TECHNIQUE FOR IMPROVING EFFICIENCY OF A LINEAR VOLTAGE REGULATOR

BACKGROUND OF THE INVENTION

1. Field of the Invention

The present invention relates generally to a linear voltage regulator and, more particularly, to improving efficiency of a linear voltage regulator that employs an adaptive biasing circuit.

2. Description of the Related Art

As is well known, a linear voltage regulator is a device that is designed to receive an input voltage and provide a substantially constant output voltage at a desired level for a range of output load currents. In a typical application, an output voltage provided by a linear voltage regulator is used as a power supply voltage for other circuits, whose load current may vary over time with substantially instantaneous transitions from one current level to another current level. For example, a linear voltage regulator may supply power to one or more digital circuits of a device, e.g., a cellular telephone, a computer system, etc., whose digital circuits may or may not be functional at any given time. Thus, load currents for such devices can be relatively high in one clock cycle and relatively low in a next clock cycle. As digital circuits are designed to operate at higher frequencies, transitions between clock cycles become faster and transition times between different load current levels decrease.

A low-dropout (LDO) voltage regulator is a linear voltage regulator that maintains output voltage regulation even when an input voltage at an input terminal of the regulator is only marginally greater than a desired output voltage at an output terminal of the regulator. A relatively low-dropout voltage allows an LDO voltage regulator to operate over a wider range of input voltage levels and extends battery life in battery-powered systems, such as portable electronic devices and laptop computer systems. For example, as a battery voltage of a device gradually decreases during usage, an LDO voltage regulator facilitates operation of the device at lower battery voltages, which extends battery life between charging cycles. In an LDO voltage regulator, a power transistor is connected in series between an input terminal and an output terminal of the regulator. During operation of the regulator, the power transistor provides load current to the output terminal of the regulator. In high-speed applications, conventional LDO voltage regulators have traditionally employed a relatively high operating current to facilitate driving the power transistor at an acceptable speed. Unfortunately, LDO voltage regulators that operate using relatively high operating currents are inefficient from a current efficiency stand-point. Moreover, when employed in battery-powered systems, conventional LDO voltage regulators may substantially reduce battery life due to relatively high operating currents.

U.S. Pat. No. 6,522,111 (hereinafter "the '111 patent") discloses a low-dropout (LDO) voltage regulator. To address fast transients in load current, the LDO voltage regulator of the '111 patent also employs an adaptive biasing circuit that provides an unlimited additional operating current, that tracks the load current, in response to an increase in the load current. With reference to FIG. 1 an LDO voltage regulator 100 is illustrated that employs a steady-state biasing circuit 104, which provides a steady-state operating current, and an unlimited adaptive biasing circuit 102, which provides an unlimited additional operating current according to the '111 patent. The steady-state biasing circuit 104 includes a current source I1 and a current mirror, which includes transistors M1 and M2. The transistor M1 conducts a sourced current (supplied by the current source I1) and the transistor M2 conducts the steady-state operating current, whose level is substantially the same as or a multiple of the sourced current depending on relative geometries of the transistors M1 and M2.

The unlimited adaptive biasing circuit 102 allows for a reduction in steady-state operating current for the regulator 100, while providing an unlimited additional operating current for transient load conditions. In operation, an error amplifier A1, based on comparisons of a reference voltage (VREF) and a feedback voltage (VFB), drives a power transistor M6 to achieve a desired output voltage (VOUT) substantially independent of load current ($I_L$), over a load current range. In operation, when the load current increases substantially instantaneously from a relatively small value to a relatively large value, the output voltage at the output terminal of the regulator 100 drops unless the power transistor M6 conducts more load current and/or load capacitor (CL) supplies the instantaneous load current required.

In this application, the regulator 100 provides load regulation (i.e., an ability to maintain a substantially constant output voltage level under changing load conditions) by providing an indication of a load condition change to the error amplifier A1, via the feedback voltage (provided by a resistive divider including resistors R1 and R2). The error amplifier A1 drives the power transistor M6 harder when the output voltage is below a desired level. Conversely, the error amplifier A1 controls the power transistor M6 to decrease output voltage when the output voltage is above a desired level. To improve transient response time of the LDO voltage regulator 100 to changing load conditions, the unlimited adaptive biasing circuit 102 temporarily increases an operating current of the error amplifier A1 to facilitate faster charging (or discharging) of a gate capacitance of the power transistor M6. The unlimited adaptive biasing circuit 102 includes a current mirror, which includes transistors M3 and M4, and a sense transistor M5. The sense transistor M5 conducts a sensed current that is a sub-multiple of the output load current conducted by the power transistor M6. The transistor M4 conducts the sensed current and the transistor M3 conducts an unlimited additional operating current, whose level is substantially the same as or a multiple of the sensed current, depending on relative geometries of the transistors M3 and M4.

Implementing the unlimited adaptive biasing circuit 102 within the regulator 100 allows a designer to decrease steady-state operating current of the error amplifier A1, while still providing satisfactory transient performance for the regulator 100 during load current transients. As such, the regulator 100 is generally more efficient than conventional LDO voltage regulators that do not employ an unlimited adaptive biasing circuit. However, the regulator 100 provides an unlimited additional operating current, which is based on and tracks the load current. As such, the unlimited adaptive biasing circuit 102 may increase operating currents to unnecessary levels during transients in the load current, thus, decreasing the efficiency of the regulator 100.

What is needed is a linear voltage regulator that provides acceptable transient response while utilizing a limited additional operating current.

BRIEF DESCRIPTION OF THE DRAWINGS

This invention is described in a preferred embodiment in the following description with reference to the drawings, in which like numbers represent the same or similar elements, as follows.

Figure 1:
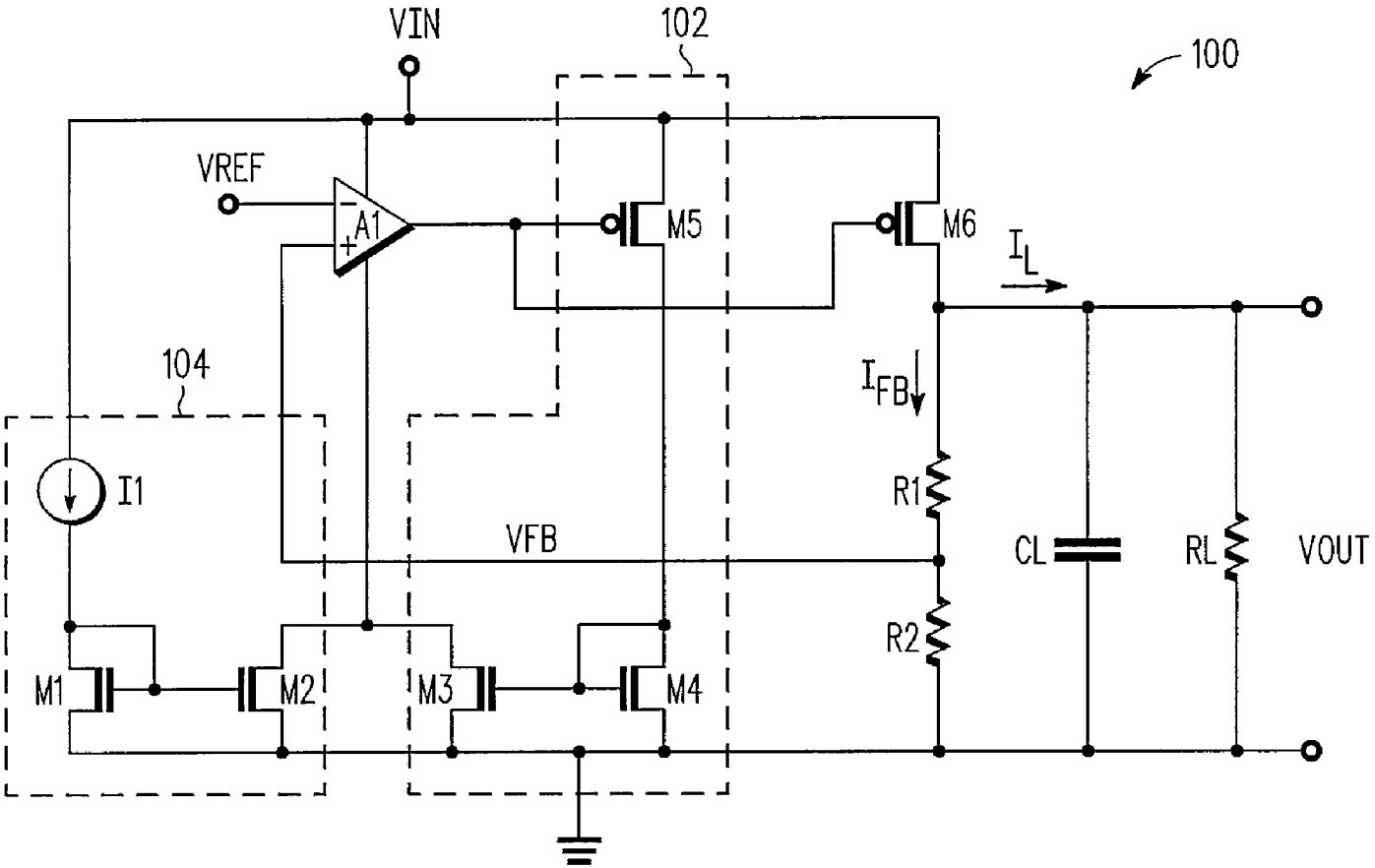
FIG. 1 is an electrical diagram, in block and schematic form, of a conventional low-dropout (LDO) voltage regulator.

In the following detailed description of exemplary embodiments of the invention, reference is made to the accompanying drawings, which form a part hereof, and in which is shown by way of illustration specific exemplary embodiments in which the invention may be practiced.

DETAILED DESCRIPTION OF PREFERRED EMBODIMENTS

In the following detailed description of exemplary embodiments of the invention, specific exemplary embodiments in which the invention may be practiced are described in sufficient detail to enable those skilled in the art to practice the invention, and it is to be understood that other embodiments may be utilized and that logical, architectural, programmatic, mechanical, electrical and other changes may be made without departing from the spirit or scope of the present invention. The following detailed description is, therefore, not to be taken in a limiting sense, and the scope of the present invention is defined only by the appended claims. In particular, although the preferred embodiment is described below with respect to a wireless mobile communication device, it will be appreciated that the present invention is not so limited and that it has application to other embodiments of electronic devices such as portable digital assistants (PDAs), digital cameras, portable storage devices, audio players, portable gaming devices and computing systems, for example.

As noted above, a linear voltage regulator is a circuit that is designed to provide a stable direct current (DC) output voltage that is relatively independent of a load current, over a load current range. In general, a linear voltage regulator should provide an output voltage with relatively low variation even when a fast transient in load current occurs. A low-dropout (LDO) voltage regulator is a linear voltage regulator that commonly uses a P-channel metal-oxide semiconductor (PMOS) transistor in series between input and output terminals of the regulator. While the discussion herein is primarily directed to an LDO voltage regulator, it is contemplated that the disclosed techniques are broadly applicable to other types of linear voltage regulators.

As noted above, an error amplifier of a conventional linear voltage regulator has implemented a relatively high operating (quiescent) current in order to provide relatively good transient response to changing output load currents. Unfortunately, in battery-powered devices, e.g., cellular telephones, a high operating current may be unacceptable as the high operating current may reduce battery life and may require frequent battery charging. As noted above, the '111 patent discloses a low-dropout (LDO) voltage regulator that draws a relatively low operating current for steady-state operation. To address fast transients in the output load current, the LDO voltage regulator of the '111 patent also employed an unlimited adaptive biasing circuit that provided an unlimited additional operating current, that tracked a load current, in response to an increase in the load current. While providing an unlimited additional operating current improves transient response of an LDO voltage regulator, the adaptive biasing circuit disclosed in the '111 patent may increase operating currents to unnecessary levels during fast load current transients.

According to various aspects of the present disclosure, a limited adaptive biasing circuit, implemented within a linear voltage regulator, is designed to provide a limited additional operating current, whose level is based on a given application. In this manner, the current efficiency of the regulator is generally improved. According to this approach, a designer estimates a limited additional operating current that is required for a particular application. During operation of the regulator, the operating current is adaptively increased by the limited additional operating current when a load current increase occurs. This generally increases current efficiency of the voltage regulator, without undesirable performance degradation, as the current efficiency of a voltage regulator is given by:

$$CurrentEfficiency = \frac{I_{LOAD}}{I_{TOTAL}} = \frac{I_{LOAD}}{I_{LOAD} + I_Q}$$

where, $I_{LOAD}$ is the load current and $I_Q$ is the operating (quiescent) current.

Figure 2:
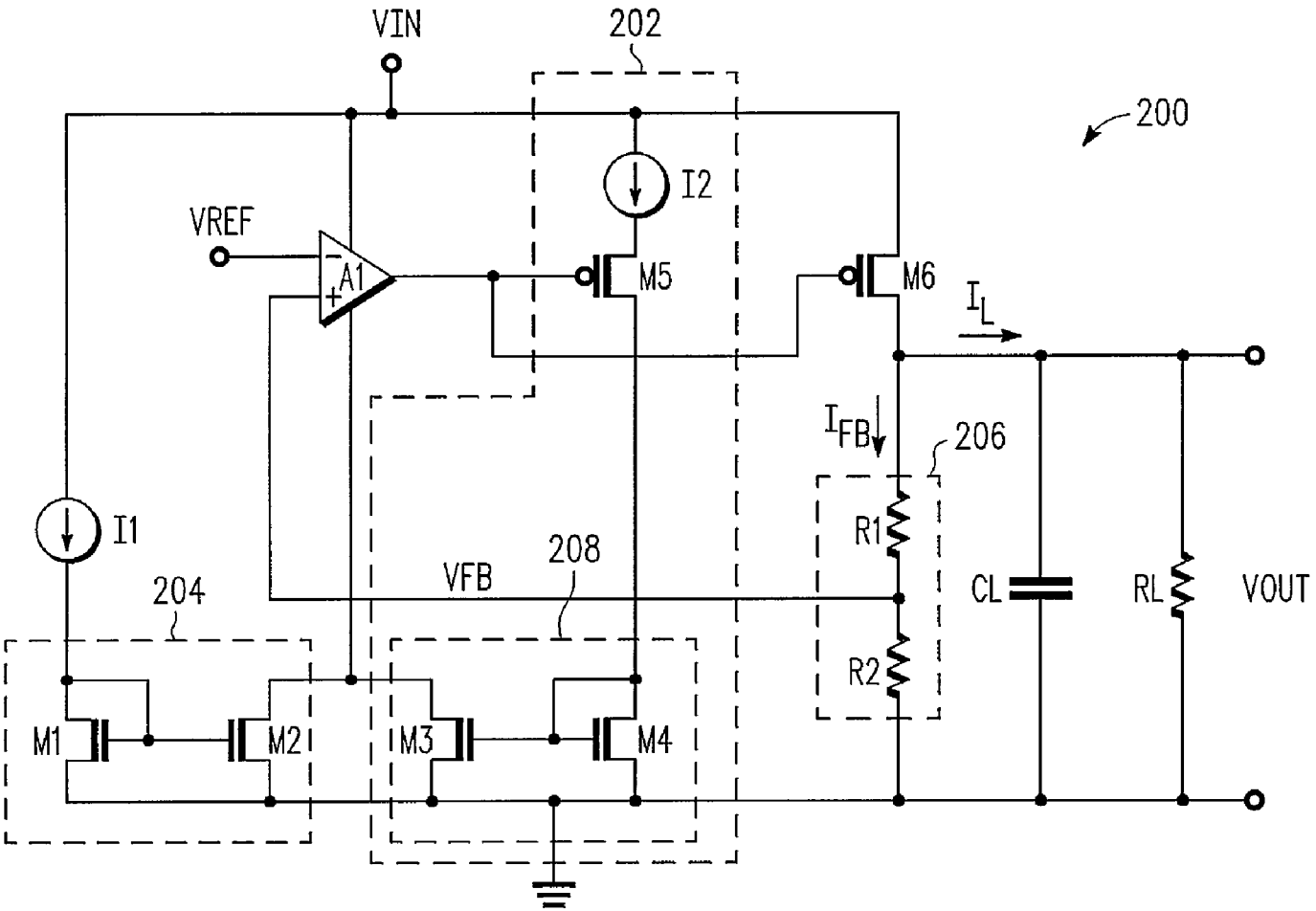
FIG. 2 is an electrical diagram, in block and schematic form, of an LDO voltage regulator configured according to an embodiment of the disclosure.

With reference to FIG. 2, a linear voltage regulator 200, which is configured as a low-dropout (LDO) voltage regulator, includes a first current mirror 204, which includes transistors M1 and M2, that provides a minimum operating current needed for steady-state operation (i.e., no load current or a relatively low load current). The first current mirror 204 may be, for example, a 1:1 current mirror. Assuming the first current mirror 204 is a 1:1 current mirror, the minimum operating current substantially assumes a current level provided by first current source I1. The regulator 200 also includes a limited adaptive biasing circuit 202, which includes transistors M3, M4, and M5 and a second current source I2. The second current source I2 provides a sourced current that is used to adaptively increase the operating current of the regulator 200. The transistors M3 and M4 form a second current mirror 208, which may also be a 1:1 current mirror. Assuming the second current mirror 208 is a 1:1 current mirror, the limited additional operating current substantially assumes a current value provided by the second current source I2. During load transient conditions, a total operating current of the error amplifier A1 is equal to the sum of the limited additional operating current and the minimum operating current. In this application, the transistor M5 essentially functions as a switch and is in a high impedance state when no load current ($I_L$) (or relatively low load current) is flowing through transistor M6. As is shown, a feedback current ($I_{FB}$) also flows through the transistor M6 and a feedback circuit 206, which includes resistors R1 and R2.

When the second current mirror 208 is in a cut-off state, an operating current of error amplifier A1 is essentially the minimum operating current. When the load current starts to increase, the transistor M5 is switched to a low impedance state due to an error voltage (provided at an output of the error amplifier A1) at a gate of the transistor M5. When the transistor M5 is in a low impedance state, the second current source I2 biases the second current mirror 208 (including the transistors M3 and M4) and the limited additional operating current (conducted by the transistor M3) is summed with the minimum operating current (conducted by the transistor M2). In this manner, the operating current of the error amplifier A1 is limited (e.g., to the current provided by current sources I1 and I2) despite further increases in the load current. As noted above, the regulator 200 also includes the feedback circuit 206, e.g., a resistive divider including resistors R1 and R2. The feedback circuit 206 provides a feedback signal (VFB) to a non-inverting input of the error amplifier A1. An inverting input of the error amplifier A1 receives a reference signal (VREF) from a voltage reference circuit, e.g., a zener diode circuit or a bandgap reference circuit. The error amplifier A1 functions as a control circuit and provides a control signal to control terminals of the transistors M5 and M6 based upon the feedback signal and the reference signal. The error amplifier A1 may be, for example, a one-stage operational amplifier, a multi-stage operational amplifier, an operational transconductance amplifier (OTA). Alternatively, the error amplifier may be replaced with another control circuit, e.g., a microprocessor, microcontroller, programmable logic device (PLD), etc. In one or more embodiments, the transistor M6 is a power transistor, e.g., a bipolar junction transistor (BJT), an insulated-gate bipolar transistor (IGBT), or a metal-oxide semiconductor field-effect transistor (MOSFET). In the embodiment shown in FIG. 2, the transistors M1-M4 are n-channel MOSFETs and the transistors M5-M6 are p-channel MOSFETs. It should, however, be appreciated that other types of transistors (e.g., BJTs) and different circuit configurations may be employed in a regulator configured according to the techniques disclosed herein.

Figure 3:
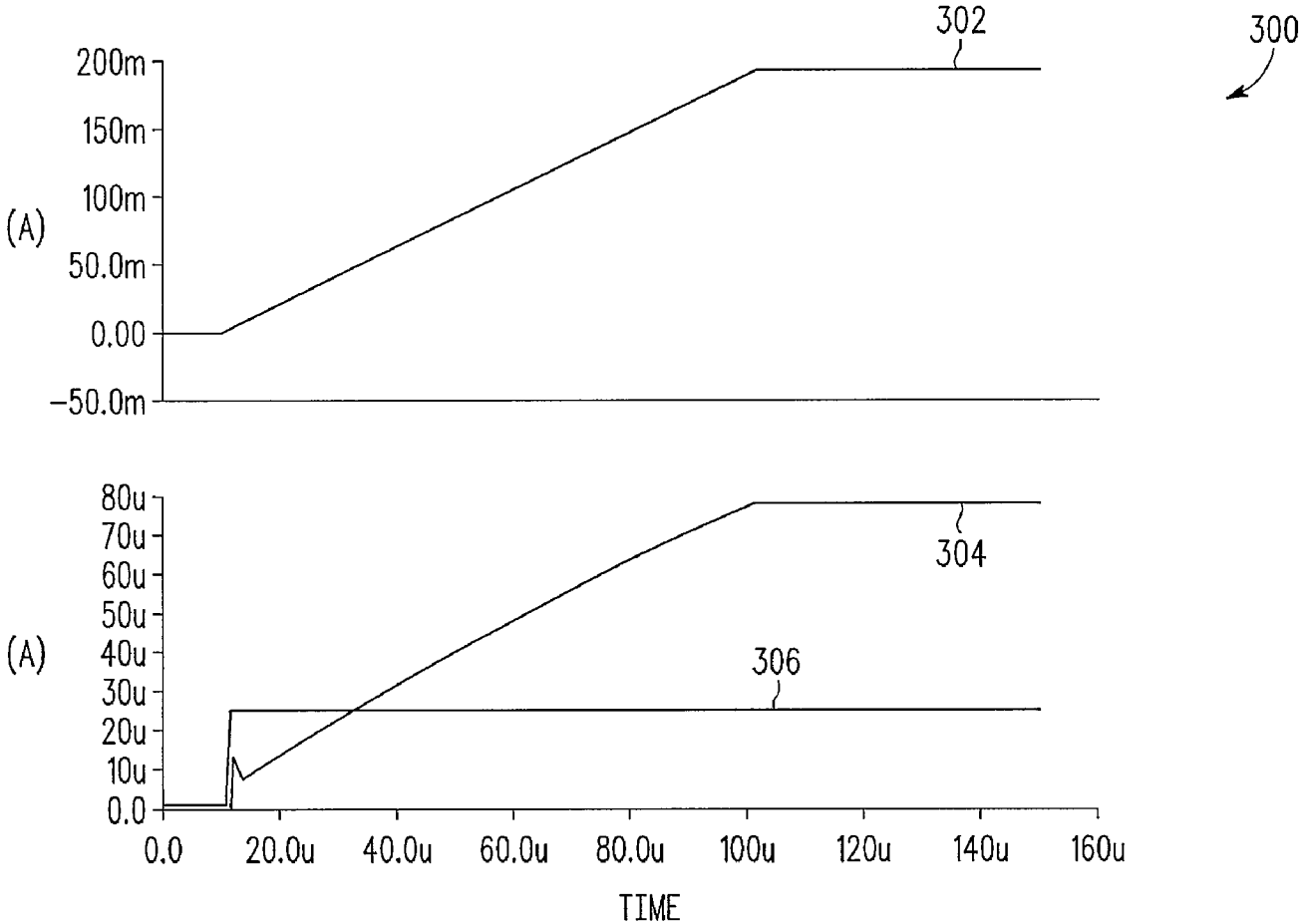
FIG. 3 is a signal graph depicting a transient load current curve and additional operating current curves associated with the transient load current for the regulators of FIGS. 1 and 2.

Moving to FIG. 3, a graph 300 depicts curves 304 and 306 which correspond to additional operating currents for the conventional regulator 100 of FIG. 1 and the regulator 200 of FIG. 2, respectively, for a load current 302 that has transitioned from about zero to a maximum load current of about 200 mA. With reference to the curve 304, the additional operating current for the conventional regulator 100 of FIG. 1 continues to increase (tracks) with the output load current 302. In contrast, as is shown by the curve 306, the additional operating current for the regulator 200 of FIG. 2 increases substantially instantaneously to the current source I2 value (about 25 uA in this example) and then remains substantially constant. Thus, the regulator 200 has a lower total operating current than the regulator 100 and, as such, has higher current efficiency.

Figure 4:
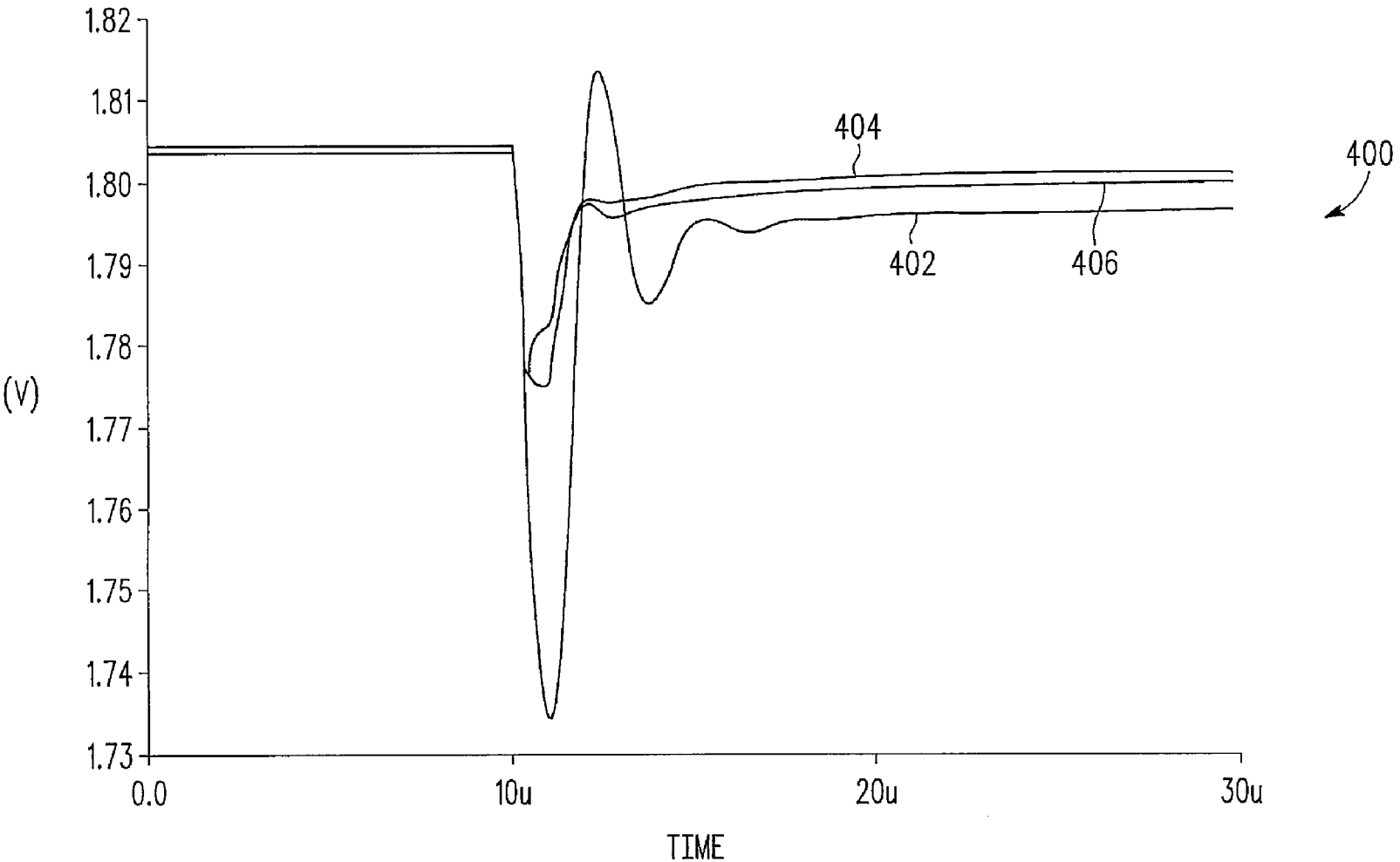
FIG. 4 is a signal graph depicting output voltages curves for a conventional LDO voltage regulator and the regulators of FIGS. 1 and 2 in response to a transient load current.

With reference to FIG. 4, a graph 400 is depicted that illustrates a transient response in an output voltage (VOUT) to a 200 mA step in load current for a number of power supply regulators. More specifically, curve 402, which has considerable over-shoot and under-shoot, plots the output voltage for a conventional LDO voltage regulator that does not employ an adaptive biasing circuit. Curve 404 corresponds to the output voltage for the regulator 100 of FIG. 1, which employs a conventional unlimited adaptive biasing circuit. Curve 406 corresponds to the output voltage for the regulator 200 of FIG. 2, which employs a limited adaptive biasing circuit configured according to the present disclosure. It should be noted that the curves 404 and 406 show a similar transient response in the output voltage. However, as noted above, the regulator 200 has a higher current efficiency than the regulator 100, as the operating current for the regulator 200 is lower that the operating current for the regulator 100.

Figure 5:
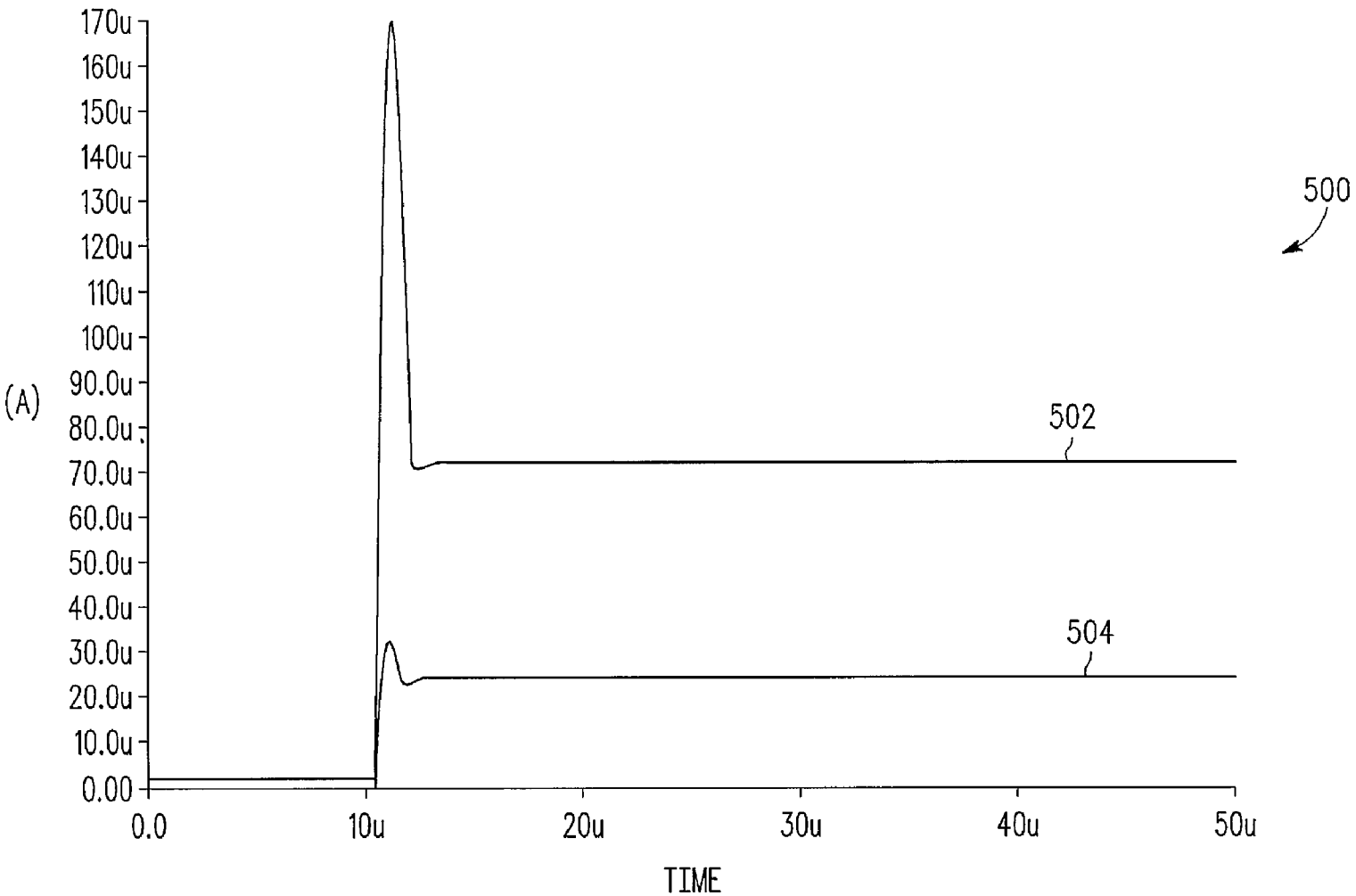
FIG. 5 is a signal graph depicting additional operating current curves associated with a transient load current for the regulators of FIGS. 1 and 2.

Turning to FIG. 5, a graph 500 shows additional (adaptive) operating currents 502 and 504 for the regulator 100 of FIG. 1 and the regulator 200 of FIG. 2, respectively, responsive to a same 200 mA step in load current ($I_L$). The curve 502 indicates that the unlimited adaptive biasing circuit 102 of FIG. 1 exhibits a relatively high over-shoot in additional operating current for the error amplifier A1, as the additional operating current tracks the output load current. In contrast, as is shown by the curve 504, the limited adaptive biasing circuit 202 of FIG. 2 provides a more stable lower additional operating current for the error amplifier A1.

Figure 6:
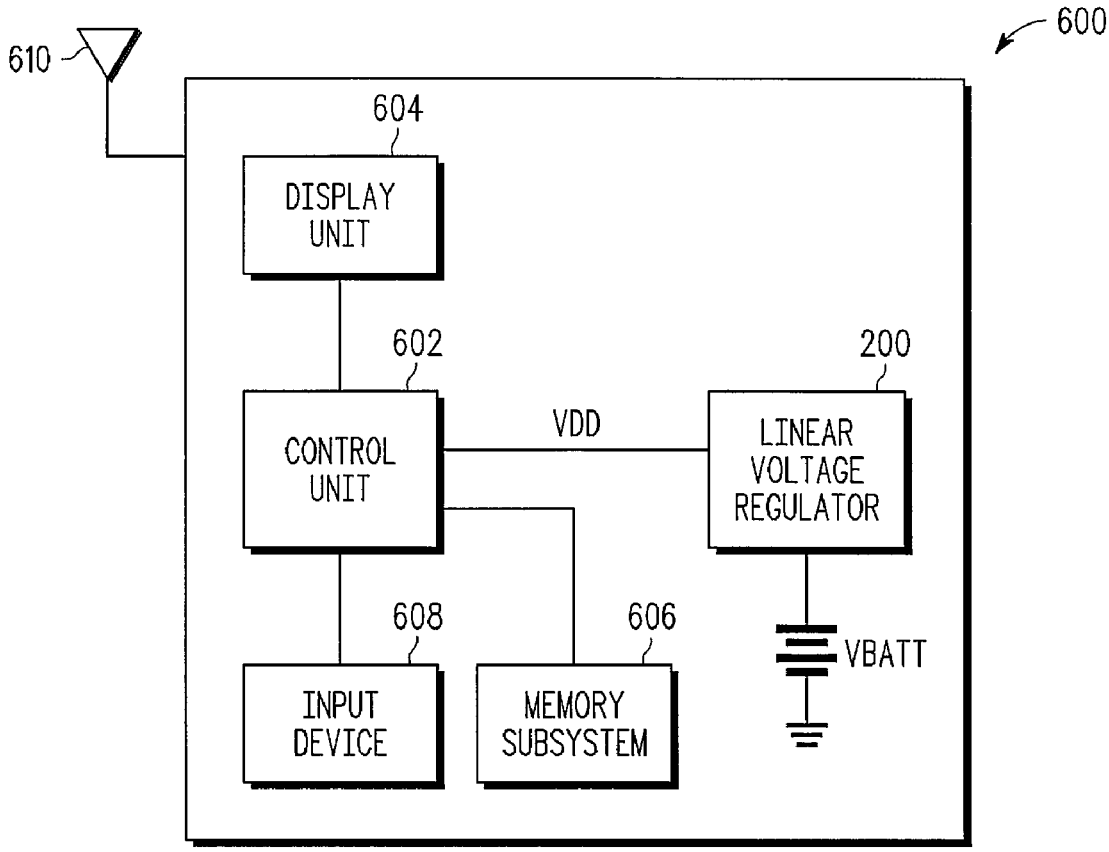
FIG. 6 is an electrical block diagram of an example system, which may be a wireless mobile communication device, that employs the LDO voltage regulator of FIG. 2.

With reference to FIG. 6, an example system 600 is illustrated that employs the LDO voltage regulator 200 of FIG. 2 to power one or more components of the system 600. As is shown, the regulator 200 receives an input voltage provided by a battery (VBATT) and provides an output voltage (VDD) that powers a control unit (load) 602, which may be a microprocessor, microcontroller, etc. The regulator 200 may also be employed within systems that are not battery-powered, e.g., systems that derive power from an alternating current (AC) power source. It should be appreciated that multiple LDO voltage regulators 200 may be employed within the system 600 to provide power at different voltage levels to different components (loads) of the system 600. As is shown, the control unit 602 is coupled to a display unit 604, e.g., a liquid crystal display (LCD), a memory subsystem 606, and an input device 608, e.g., a keypad. The system 600 may include an antenna 610 and a transceiver (not shown) when the system 600 takes the form of a mobile wireless communication device.

Accordingly, linear voltage regulators have been disclosed herein that exhibit increased current efficiency for a range of load currents. The disclosed embodiments generally reduce overshoots attributable to an additional operating current. An appropriate magnitude for a limited additional operating current may be determined for a given application by analyzing output voltage levels of the regulator in response to fast pulses of load transient current expected for a given application. In this manner, an operating current for a linear voltage regulator may be selected to provide a desired load transient response while at the same time optimizing current efficiency of the regulator.

While the invention has been particularly shown and described with reference to preferred embodiments, it will be understood by those skilled in the art that various changes in form and detail may be made therein without departing from the spirit and scope of the invention. Any variations, modifications, additions, and improvements to the embodiments described are possible and may fall within the scope of the invention as detailed within the following claims.

What is claimed is:

1. A linear voltage regulator having an input terminal and an output terminal, the linear voltage regulator comprising:

a first transistor including a first terminal coupled to the input terminal, a second terminal coupled to the output terminal and a control terminal, wherein the first transistor is configured to provide a load current to the output terminal at a desired voltage level based on a control signal on the control terminal;

a feedback circuit coupled to the output terminal, wherein the feedback circuit is configured to generate a feedback signal based on an actual voltage level at the output terminal; and a control circuit configured to have a first operating current when functional, wherein the control circuit is configured to provide, based on the feedback signal, the control signal at a level to substantially maintain an output voltage at the output terminal at the desired voltage level, and wherein the control circuit includes an adaptive biasing circuit that is configured to provide a second operating current responsive to a transient increase in the load current, where a magnitude of the second operating current is predetermined and the first and second operating currents combine to provide a total operating current for the control circuit during the transient increase in the load current.

2. The linear voltage regulator of claim 1, wherein the first transistor is a power transistor.

3. The linear voltage regulator of claim 1, wherein the linear voltage regulator is a low-dropout (LDO) voltage regulator.

4. The linear voltage regulator of claim 1, wherein the total operating current does not track the load current.

5. The linear voltage regulator of claim 1, wherein the feedback circuit includes a resistive divider.

6. The linear voltage regulator of claim 1, wherein the control circuit further comprises:

an error amplifier having an output that is configured to provide the control signal, wherein the level of the control signal is based on a difference between a magnitude of the feedback signal and a magnitude of a reference signal.

7. The linear voltage regulator of claim 6, wherein the control circuit further comprises:

a first current mirror; and a first current source coupled between the input terminal and the first current mirror, wherein the first current mirror is configured to provide the first operating current for the control circuit when the linear voltage regulator is operable.

8. The linear voltage regulator of claim 7, wherein the adaptive biasing circuit includes a second current source, a second transistor and a second current mirror, wherein the second current source is coupled between the input terminal and a first terminal of the second transistor, and wherein a second terminal of the second transistor is coupled to the second current mirror and a control terminal of the second transistor is coupled to the output of the error amplifier.

9. The linear voltage regulator of claim 7, wherein a level of the second operating current is substantially independent of a level of the load current.

10. The linear voltage regulator of claim 6, wherein the error amplifier is a single-stage operational amplifier, a multi-stage operational amplifier, or an operational transconductance amplifier.

11. A system, comprising:

a load including an input; and a linear voltage regulator having an input terminal configured to be coupled to a direct current (DC) power source and an output terminal coupled to the input of the load, the linear voltage regulator comprising:

a first transistor including a first terminal coupled to the input terminal, a second terminal coupled to the output terminal and a control terminal, wherein the first transistor is configured to provide a load current to the output terminal at a desired voltage level based on a control signal on the control terminal;

a feedback circuit coupled to the output terminal, wherein the feedback circuit is configured to generate a feedback signal based on an actual voltage level at the output terminal; and a control circuit configured to have a first operating current, wherein the control circuit is configured to provide, based on the feedback signal, the control signal at a level to substantially maintain an output voltage at the output terminal at the desired voltage level, and wherein the control circuit includes an adaptive biasing circuit that is configured to provide a second operating current responsive to a transient increase in the load current, where a magnitude of the second operating current is predetermined and the first and second operating currents combine to provide a total operating current for the control circuit during the transient increase in the load current, and where the total operating current does not track the load current and the linear voltage regulator is a low-dropout (LDO) voltage regulator.

12. The system of claim 11, wherein the first transistor includes a power transistor, and wherein the power transistor is a bipolar junction transistor (BJT), an insulated-gate bipolar transistor (IGBT), or a metal-oxide semiconductor field-effect transistor (MOSFET).

13. The system of claim 11, wherein the control circuit further comprises:

an error amplifier having an output that is configured to provide the control signal, wherein the level of the control signal is based on a difference between a magnitude of the feedback signal and a magnitude of a reference signal.

14. The system of claim 13, wherein the control circuit further comprises:

a first current mirror; and a first current source coupled between the input terminal and the first current mirror, wherein the first current mirror is configured to provide the first operating current for the control circuit when the linear voltage regulator is operable.

15. The system of claim 14, wherein the adaptive biasing circuit includes a second current source, a second transistor and a second current mirror, wherein the second current source is coupled between the input terminal and a first terminal of the second transistor, and wherein a second terminal of the second transistor is coupled to the second current mirror and a control terminal of the second transistor is coupled to the output of the error amplifier.

16. The system of claim 15, wherein a level of the second operating current is substantially independent of the load current.

17. The system of claim 13, wherein the error amplifier is a single-stage operational amplifier, a multi-stage operational amplifier, or an operational transconductance amplifier.

* * * * *